United States Patent [19]

Smith

[11] Patent Number: 4,550,958

[45] Date of Patent: Nov. 5, 1985

[54] ELECTRICAL HOSE SWIVEL CONNECTOR FOR CANISTER VACUUM CLEANER

[75] Inventor: Orbert S. Smith, Baldwin Township, Sherburn County, Minn.

[73] Assignee: Whirlpool Corporation, Benton Harbor, Mich.

[21] Appl. No.: 651,102

[22] Filed: Sep. 17, 1984

[51] Int. Cl.[4] ..... H01R 39/00

[52] U.S. Cl. ..... 339/5 R; 339/16 R

[58] Field of Search ..... 339/5, 6, 8, 15, 16

[56] References Cited

U.S. PATENT DOCUMENTS

| | | | |
|---|---|---|---|
| 3,407,373 | 10/1968 | Brown et al. | 339/5 |
| 3,470,521 | 9/1969 | Downey | 339/8 |
| 3,546,656 | 12/1970 | Pritulsky | 335/16 |
| 3,553,629 | 1/1971 | Brown et al. | 339/15 |
| 4,003,616 | 1/1977 | Springer | 339/8 R |
| 4,012,091 | 3/1977 | Westergren | 339/15 |
| 4,063,790 | 12/1977 | Kleykamp et al. | 339/16 R |
| 4,094,535 | 6/1978 | Minton | 285/7 |
| 4,117,287 | 9/1978 | Walker et al. | 339/16 R |
| 4,143,930 | 3/1979 | Schauer | 339/6 R |
| 4,162,370 | 7/1979 | Dunn et al. | 174/47 |
| 4,188,081 | 2/1980 | Holden et al. | 339/15 |
| 4,283,594 | 8/1981 | Somers | 174/47 |
| 4,345,805 | 8/1982 | Finley et al. | 339/16 R |

*Primary Examiner*—Joseph H. McGlynn

*Attorney, Agent, or Firm*—Wood, Dalton, Phillips, Mason & Rowe

[57] ABSTRACT

A vacuum cleaner construction wherein a swivel connector is secured to a top wall portion of the canister hood. The swivel connector is adapted to have unlimited rotation about the swivel axis, permitting the user to utilize the suction hose and wand of the vacuum cleaner in any position circumferentially about the canister. The swivel connector includes electrical power transfer structure for providing electrical power therethrough from the canister to electrical conductors carried by the hose and wand for use in energizing the nozzle brush motor or the like. In the illustrated embodiment, the electrical connection structure includes slip rings and cooperating sliders connected to a power receptacle mounted to the swivel member.

19 Claims, 5 Drawing Figures

FIG. 1
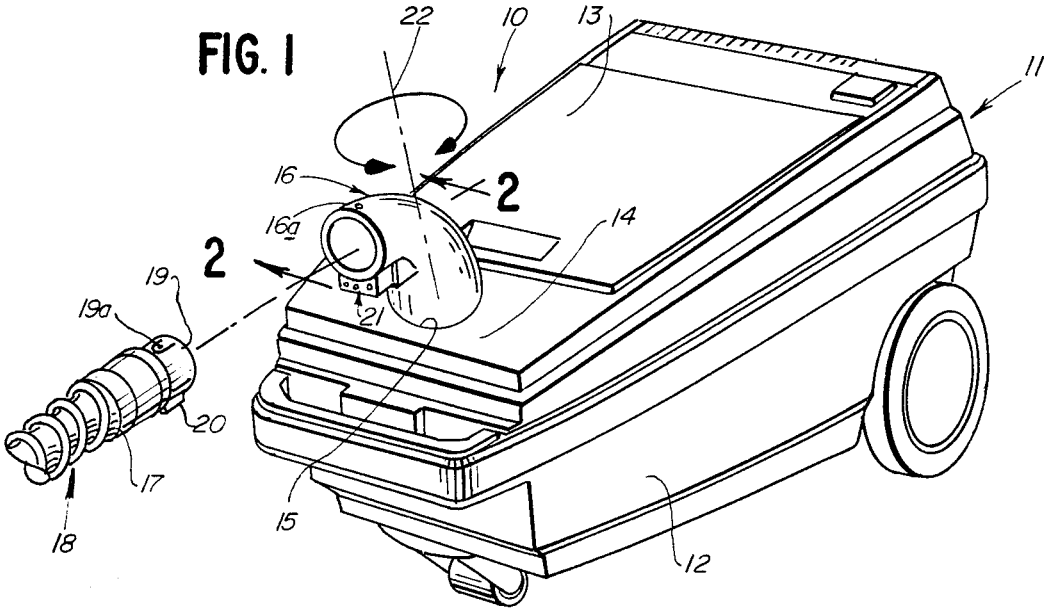
FIG. 2
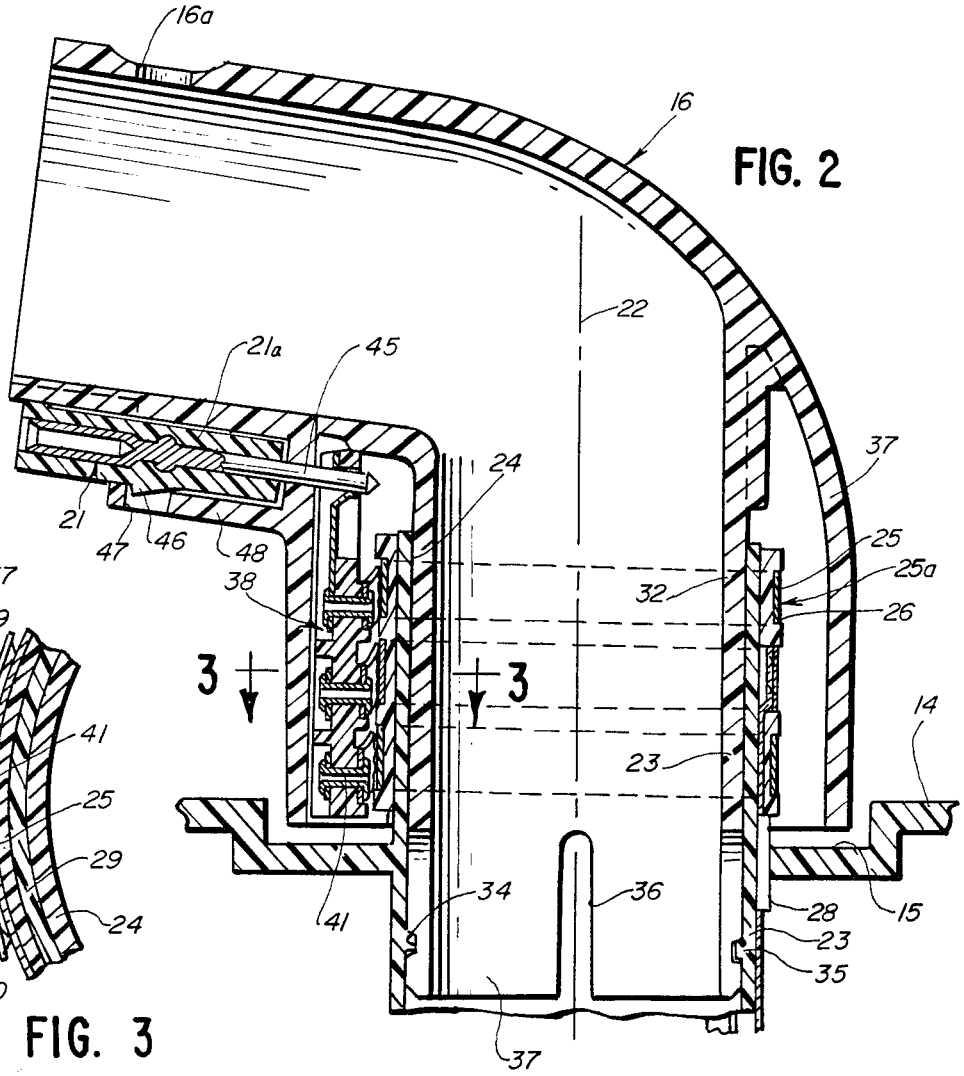
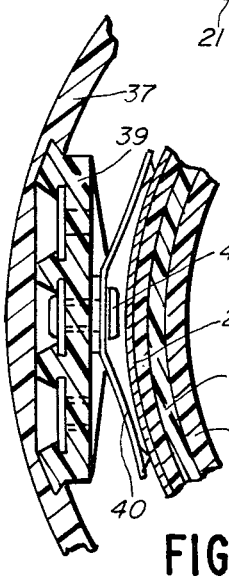
FIG. 3

ELECTRICAL HOSE SWIVEL CONNECTOR FOR CANISTER VACUUM CLEANER

BACKGROUND OF THE INVENTION

1. Field of the Invention

This invention relates to vacuum cleaners and in particular to means for swivelly connecting a suction hose to a vacuum cleaner canister.

2. Description of the Background Art

In one conventional form of vacuum cleaner, the dirt pickup nozzle is connected through a suction hose to a wheeled canister provided with a suction fan and filter bag. The wheeled dirt pickup nozzle may include a hollow wand which is connected to the flexible suction hose.

In one conventional form, the nozzle is provided with a power driven brush requiring the provision of electrical energy from the canister through the suction hose and wand to the brush motor carried by the nozzle.

In the conventional use of such canister-type vacuum cleaners, the user extends the suction hose and wand from the cànister in moving the suction nozzle over the surface to be vacuum cleaned. It is desirable to permit the user to move the nozzle about the canister and a number of devices have been developed for swivelly connecting the end of the suction hose to the canister facilitating such movement.

It is conventional to provide a hose connector which is removably inserted into the suction inlet portion of the canister. Means are conventionally provided for maintaining the electrical connection between the electrical conducting means of the hose and the power source means associated with the canister, while yet permitting the desired swivelling movement of the hose about the canister in use.

One example of an excellent canister-type vacuum cleaner having a current-carrying hose is disclosed in U.S. Pat. No. 4,012,091 of George A. Westergren, which patent is owned by the assignee hereof. As shown in the Westergren patent, the electrical terminal means of the hose comprise a terminal adapter removably connected to the hose end to have electrical connection with contacts provided within the hose and attached to the hose wires. As further illustrated in the Westergren patent, a retaining means is defined by a housing extending about the adapter terminals forming an electrical receptacle for connection thereto of a conventional electrical connector. The terminal adapter is replaceable in the hose construction for facilitated maintenance.

M. John Somers discloses, in U.S. Pat. No. 4,283,594, a canister vacuum cleaner wherein the electrical conductors of the hose are connected to a power source means carried by the canister through a cable having male and female plugs respectively at opposite ends. In connecting the hose to the suction means of the canister, one end of the hose is connected to a suction inlet. The electrical connection is made in a separate operation.

A similar arrangement is disclosed in U.S. Pat. No. 4,063,790 of Donald L. Kleykamp et al.

SUMMARY OF THE INVENTION

The present invention comprehends an improved swivel-type connector for use with a canister-type vacuum cleaner in connecting the suction hose to the canister. The invention comprehends providing such a swivel-type connector which is mounted to the canister and provided with a hose connecting portion removably receiving the end of the suction hose.

The swivel connector is provided with electrical power supply structure providing power to the electrical conductors of the suction hose automatically as an incident of the connection of the suction hose to the swivel connector.

The swivel connector includes a portion removably secured to the housing of the canister having unlimited swivelling movement.

The electrical connection includes a slip ring associated with the canister and slider followers associated with the swivel connector and electrically connected to a receptacle disposed for removably receiving the electrical connection means of the hose end.

More specifically, the invention comprehends the provision in a vacuum cleaner having a canister defining a housing wall portion, and a suction hose having an end provided with a hose end connector and a power plug, a swivel connector for removably connecting the hose end connector to the canister including a tubular suction inlet fixedly mounted to the canister and having a distal portion projecting outwardly from the housing wall portion and defining a swivel axis, a plurality of longitudinally spaced electrically conductive commutator rings coaxially on the distal portion of the suction inlet, each ring having an electrically conductive connecting portion extending therefrom inwardly through the housing top wall portion into the canister for providing an electrical power connection therein, a swivel member having a tubular insert portion coaxially rotatably retained in the tubular suction inlet, and a turned tubular outer end portion extending angularly to the insert portion for swinging 360° about the swivel axis as an incident of rotation of the insert portion in the tubular inlet, a plurality of electrical slide connectors on the tubular insert portion of the swivel member biased into sliding electrical contact one each with the commutator rings, electrical power transfer means on the swivel member for removably electrically connecting a hose power plug thereto, means electrically connecting the electrical power transfer means to the slide connectors, and means on the outer end portion of the swivel member for removably connecting a suction hose end connector thereto.

In the illustrated embodiment, the canister wall portion comprises a generally horizontally extending top wall portion thereof.

In the illustrated embodiment, the swivel member defines a substantially L-shaped member defining contiguous inner portions of the insert portion and turned outer end portion, with the electrical power transfer means disposed on the inner portion of the outer end portion of the swivel member.

In the illustrated embodiment, the slide connectors are disposed on the inner portion of the insert portion.

Means are provided for electrically connecting the electrical power transfer means to the slide connectors.

Interlock means are provided for releasably locking the insert portion of the swivel member to the tubular suction inlet against longitudinal withdrawal therefrom, while permitting 360° rotation of the swivel member. In the illustrated embodiment, the suction inlet is formed integrally with the canister top wall.

The canister top wall, in the illustrated embodiment, is recessed about the suction inlet and the swivel member insert portion includes a radially outer portion received in that recess.

In the illustrated embodiment, the swivel member includes electrical connection means providing electrical connection to the hose as an incident of securing the hose end to the hose connector and unlimitedly rotatable electrical supply means carried by the hose connector for providing electrical power to the electrical connection means in all swivelly rotated positions of the hose connector.

The interlock means and the electrical supply means comprise annular structures disposed coaxially of the swivel axis. In the illustrated embodiment, the interlock means comprises cooperating annular shoulder means on the canister and hose connector, respectively.

In the illustrated embodiment, the annular shoulder means on the hose connector comprises an annular array of deflectible tongues.

The vacuum cleaner structure of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein:

FIG. 1 is a fragmentary perspective view of a vacuum cleaner structure embodying the invention;

FIG. 2 is a fragmentary enlarged vertical section taken substantially along the line 2—2 of FIG. 1;

FIG. 3 is a fragmentary enlarged transverse section taken substantially along the line 3—3 of FIG. 2;

DESCRIPTION OF THE PREFERRED EMBODIMENT

Figure 4:
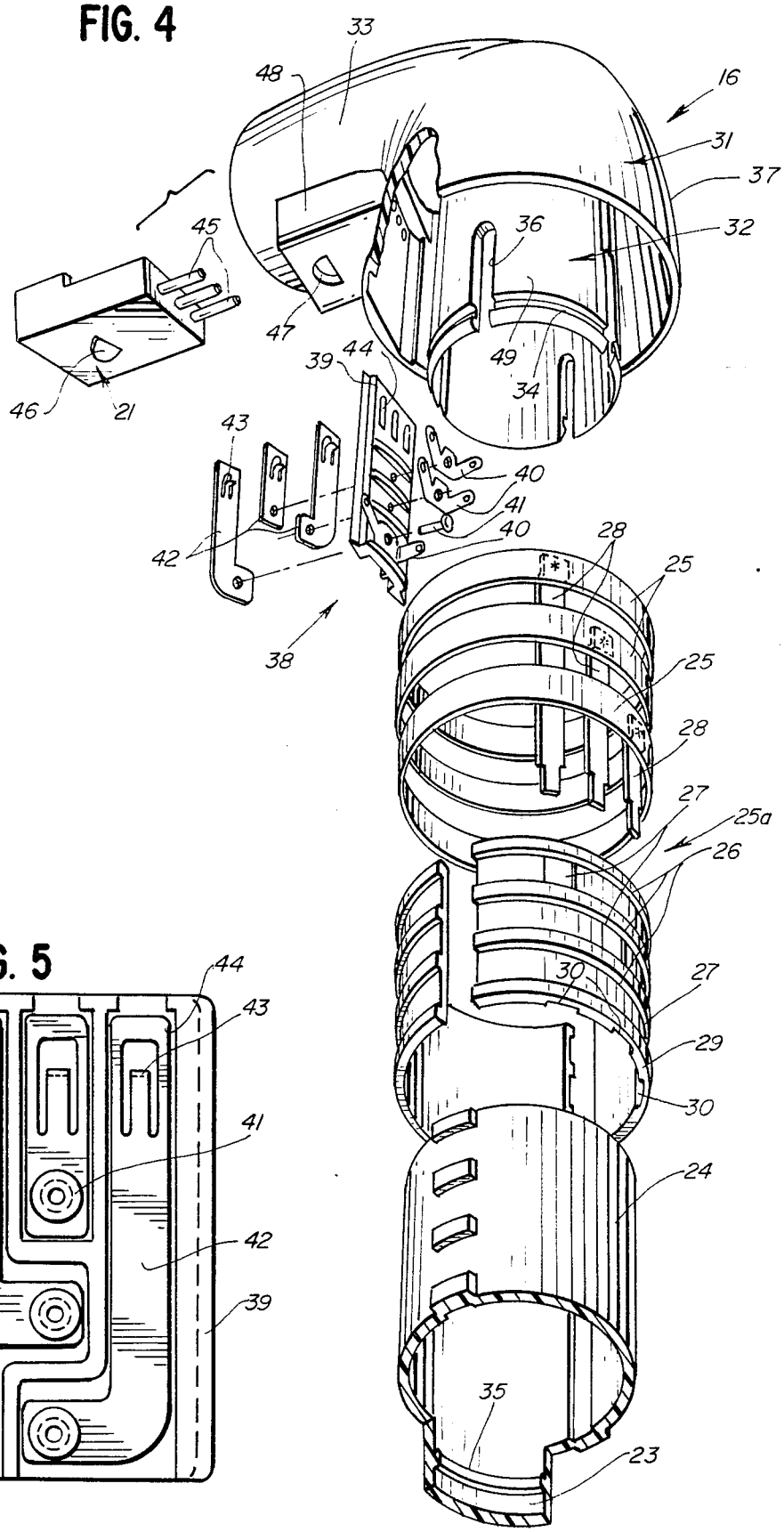
FIG. 4 is a fragmentary exploded perspective view of the swivel connector.
Figure 5:
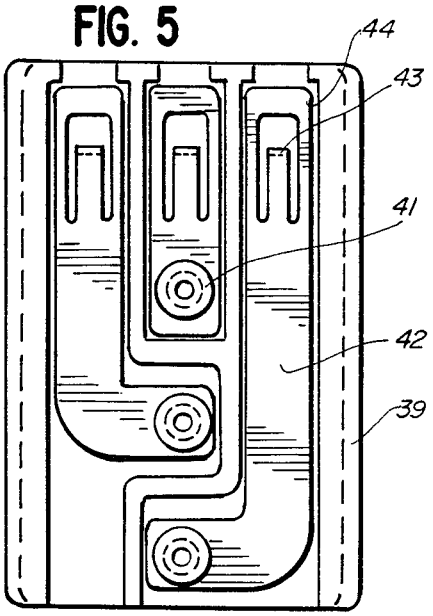
FIG. 5 is an enlarged plan view of the slide connector.

In the illustrative embodiment of the invention as disclosed in the drawing, a vacuum cleaner structure generally designated 10 is shown to include a wheeled canister generally designated 11, having a housing 12 defining a top wall 13.

Top wall 13 extends generally horizontally and includes a front portion 14 provided with a recess 15. A swivel hose connector generally designated 16 is mounted to wall portion 14 and is adapted to have a hose end connector 17 of a suction hose assembly generally designated 18 removably connected thereto. The hose end connector 17 includes a reduced diameter portion 19 adapted to be received in the swivel connector 16. The swivel hose connector 16 includes means for removably securing the hose end 17 to connector 16 comprising an aperture **16*a* formed in the top of connector 16, which aperture removably receives an upwardly biased semi-spherical projection 19*a* formed on a resilient tongue portion formed in reduced diameter portion 19. An electrical connector plug 20 is mounted on the hose end connector 17 subjacent the portion 19 for mating association with a complementary electrical receptacle 21** carried by the swivel connector.

The invention comprehends the provision of means mounting the swivel connector 16 to the canister wall portion 14 permitting unlimited swivelling of the swivel connector about the swivel axis 22 projecting from the wall portion 14, as seen in FIG. 1. Thus, in use, the hose 18 may extend outwardly away from axis 22 over the entire 360° range about the canister as desired by the user. The swivel connector is secured to the canister and, in normal use, the hose end is installed and removed therefrom, with the swivel connector being retained in association with the canister.

As further shown in FIG. 1, the swivel connector is arranged so that the electrical connection between plug 20 and receptacle 21 is effected automatically as an incident of the connection of hose end portion 19 of hose assembly 18 to the swivel connector 16. Thus, connection and disconnection of the hose relative to the canister may be readily effected by the user, while yet the swivel connector 16 provides unlimited swivelling action as desired upon completion of the connection of the hose thereto.

As shown in greater detail in FIGS. 2–4, the swivel connector 16 includes a tubular suction inlet formed integrally with the housing top wall portion 14 at the radially inner end of recess 15. As shown in FIG. 2, the inlet projects outwardly from the wall portion 14 to define a socket 24.

A plurality of longitudinally spaced, electrically conductive commutator rings 25 are mounted coaxially in grooves 26 provided in a split ring 29 defining a plurality of corresponding annular grooves 26. The grooves are provided with through openings 27 for passing strap connectors 28 mounted one each to the rings 25. The inner surface of the split ring 29 is provided with a plurality of longitudinally extending grooves 30 opening through the lower end thereof for passing the straps 28 downwardly for connection to power supply means within the canister (not shown).

Thus, in normal use, electrical power is provided to the commutator rings 25 when the vacuum cleaner is energized by the user. As discussed briefly above, the swivel connector 16 is arranged to conduct the electrical power therethrough to the plug 20 of the suction hose end 17.

As best seen in FIG. 4, the swivel connector 16 includes a swivel member 31 which is generally a substantially L-shaped member which defines contiguous inner portions and outer end portions comprising a tubular insert portion 32 coaxially rotatably retained in the tubular suction inlet socket 24, and a turned tubular outer end portion 33 extending angularly to the insert portion for swinging unlimitedly about the swivel axis defined by the insert 23 and socket 24.

The tubular insert 32, as seen in FIG. 4, is provided with an outer annular groove 34 adapted to receive a radially inwardly projecting annular rib 35 on the inlet 23 for releasably retaining the swivel member to the inlet 23. As shown in FIG. 4, the tubular insert is provided with a plurality of grooves 36 defining therebetween tongues 49 having sufficient flexibility to permit removal of the insert from the inlet 23 when desired. However, in normal use, the insert is rotatably retained on the inlet 23 of the top wall of the canister housing at all times.

The swivel member 16 further defines an outer annular shroud portion 37 spaced radially outwardly of and surrounding the insert portion 32 to define an enclosure for the commutator rings and electrical connection means generally designated 38 cooperating with the commutator rings to transfer electrical energy to the receptacle 21. More specifically, the electrical transfer means 38 includes a mounting board 39 carrying a plurality of sliders 40 slidably engaging one each the respective commutator rings 25, as illustrated in FIG. 3. As shown, each of the sliders is secured to the mounting board by suitable means, such as rivets 41, which are electrically connected to connecting straps 42 on the outer surface of the mounting board. The mounting straps include formed springy tangs 43 received in corresponding openings 44 in the upper portion of the mounting board for receiving a corresponding set of male terminals on the ends of the terminals 45 of the electrical connector receptacle 21.

As shown, the receptacle 21 is received in a receptacle housing portion 48 on the turned outer end 33 of the swivel member. Receptacle 21 includes a tang 46 received in a suitable opening 47 in the housing portion 48 for releasably locking the receptacle in the housing with the terminals 45 in electrical connected association with the straps 42 for receiving electrical energy from the commutator rings 25 through the sliders 40 electrically connected to the straps 28 by the rivets 41.

Thus, the sliders define slide connectors transferring the electrical power from the commutator rings in all rotatable positions of the swivel member, permitting the user to carry on vacuum cleaning operations in any position a full 360° around the canister. The swivel means of the present invention is mounted to the canister and, thus, is adapted for use by simply plugging the hose end 17 into the swivel connector, which action, as discussed above, automatically effects the electrical connection concurrently. Thus, the use of the swivel means of the present invention is extremely simple and permits the construction of the vacuum cleaner to be extremely economical, while yet providing long troublefree operation thereof.

The present hose swivel connector invention as shown and described employs three distinct separable modules or sub-assemblies for the transfer of power from the swivel connector 31 to the electrical conductors in the hose assembly 18. These sub-assemblies include the receptacle assembly 21 which comprises an insulator block **21*a* for supporting a set of terminals 45 having male terminals on one end of the set connecting to electrical transfer means 38 in the form of a swiveling contact assembly, and female terminals on the opposite end for receiving the electrical contacts of hose connector plug 20**.

The male terminals of receptacle assembly 21 are separably connected to the electrical transfer means sub-assembly 38 which includes the mounting board 39, sliders or slide contacts 40, rivets 41, connecting straps 42, strap tangs 43 and openings 44, with the male terminals of receptacle assembly 21 being engaged by the strap tangs 43 as shown.

The electrical transfer means 38, which movably carries slide contacts 40 and thereby functions as a swivelling contact sub-assembly, cooperates with a stationary contact subassembly **25*a* which includes stationary commutator rings 25, mounting grooves 26, split ring 29 and longitudinally extending grooves 30 for passing the strap connectors 28**.

It will be appreciated by those skilled in the art that the three cooperating sub-assemblies 21, **25*a* and 38** are readily replaced in the event of a premature failure of one of these sub-assemblies.

The foregoing disclosure of specific embodiments is illustrative of the broad inventive concepts comprehended by the invention.

I claim:

1. In a vacuum cleaner having a canister defining a housing wall portion, and a suction hose having an end provided with a hose end and a power plug, the improvement comprising a swivel connector for removably connecting said hose end connection to said canister, said swivel connector comprising:

a tubular suction inlet fixedly mounted to the canister and having a distal portion projecting outwardly from said housing wall portion and defining a swivel axis;

a plurality of longitudinally spaced electrically conductive commutator rings coaxially on said distal portion of the suction inlet, each ring having an electrically conductive connecting portion extending therefrom inwardly through said housing top wall portion into said canister for providing an electrical power connection therein;

a swivel member having a tubular insert portion coaxially rotatably retained in said tubular suction inlet, and a turned tubular outer end portion extending angularly to said insert portion for swinging 360° about said swivel axis as an incident of rotation of said insert portion in said tubular inlet;

a plurality of electrical slide connectors on said tubular insert portion of the swivel member biased into sliding electrical contact one each with said commutator rings;

electrical power transfer means on said swivel member for removably electrically connecting a hose power plug thereto;

means electrically connecting said electrical power transfer means to said slide connectors; and means on said outer end portion of the swivel member for removably connecting a suction hose end connector thereto.

2. The vacuum cleaner of claim 1 wherein said canister wall portion comprises a top wall portion.

3. The vacuum cleaner of claim 1 wherein said canister wall portion comprises a generally horizontally extending top wall portion.

4. The vacuum cleaner of claim 1 wherein said swivel member defines a substantially L-shaped member defining contiguous inner portions of said insert portion and turned outer end portions, said electrical power transfer means being disposed on said inner portion of the outer end portion.

5. The vacuum cleaner of claim 1 wherein said swivel member defines a substantially L-shaped member defining contiguous inner portions of said insert portion and turned outer end portions, said slide connectors being disposed on said inner portion of the insert portion.

6. The vacuum cleaner of claim 1 wherein said swivel member defines a substantially L-shaped member defining contiguous inner portions of said insert portion and turned outer end portions, said electrical power transfer means being disposed on said inner portion of the outer end portion, and said means electrically connecting said electrical power transfer means to said slide connectors extending between said inner portions.

7. In a vacuum cleaner having a canister defining a housing wall portion, and a suction hose having an end provided with a hose end and a power plug, the improvement comprising a swivel connector for removably connecting said hose end connection to said canister, said swivel connector comprising:

a tubular suction inlet fixedly mounted to the canister and having a distal portion projecting outwardly from said housing wall portion and defining a swivel axis;

a plurality of longitudinally spaced electrically conductive commutator rings coaxially on said distal portion of the suction inlet, each ring having an electrically conductive connecting portion extending therefrom inwardly through said housing top wall portion into said canister for providing an electrical power connection therein;

a swivel member having a tubular insert portion coaxially rotatably retained in said tubular suction inlet, and a turned tubular outer end portion extending angularly to said insert portion for swinging 360° about said swivel axis as an incident of rotation of said insert portion in said tubular inlet;

a plurality of electrical slide connectors on said tubular insert portion of the swivel member biased into sliding electrical contact one each with said commutator rings;

electrical power transfer means on said swivel member for removably electrically connecting a hose power plug thereto;

means electrically connecting said electrical power transfer means to said slide connectors; means on said outer end portion of the swivel member for removably connecting a suction hose end connector thereto; and interlock means for releasably locking the insert portion of the swivel member to the tubular suction inlet against longitudinal withdrawal therefrom.

8. The vacuum cleaner of claim 7 wherein said interlock means comprises annular shoulders on said suction inlet and said swivel member insert portion permitting 360° rotation of the swivel member while retaining said insert portion against longitudinal displacement.

9. The vacuum cleaner of claim 7 wherein said suction inlet is formed integrally with said canister top

10. The vacuum cleaner of claim 7 wherein said canister top wall is recessed about said suction inlet and said swivel member insert portion includes a radially outer portion received in said recess.

11. In a vacuum cleaner having a suction hose and a canister having dirt-collecting suction means, the improvement comprising:

an L-shaped hose connector;

interlock means for swivelly securing the hose connector to said canister for unlimited swivelling movement about a swivel axis projecting from the canister;

means on said hose connector for removably securing an end of a suction hose thereto;

electrical connection means on said hose connector for providing an electrical connection to the hose as an incident of securing a hose end to the hose connector; and unlimitedly rotatable electrical supply means carried by said hose connector for providing electrical power to said electrical connection means in all swivelling rotated positions of the hose connector.

12. The vacuum cleaner of claim 11 wherein said electrical connecting and electrical supply means cooperatively comprise slip ring means.

13. The vacuum cleaner of claim 11 wherein said electrical supply means comprises a plurality of slip rings coaxially of said swivel axis.

14. The vacuum cleaner of claim 11 wherein said electrical connection means comprises slide contacts slidably engaging said electrical supply means.

15. The vacuum cleaner of claim 11 wherein said electrical connection means comprises slide contacts slidably engaging said electrical supply means and plug means electrically connected to said slide means for providing said electrical connection to the hose.

16. The vacuum cleaner of claim 11 wherein said interlock means and said electrical supply means comprises annular structures disposed coaxially of said swivel axis.

17. The vacuum cleaner of claim 11 wherein said interlock means comprises cooperating annular shoulder means on the canister and hose connector respectively.

18. The vacuum cleaner of claim 11 wherein said interlock means comprises cooperating annular shoulder means on the canister and hose connector respectively, the annular shoulder means on the hose connector comprising an annular array of deflectible tongues.

19. In a vacuum cleaner having a suction hose provided with electrical conductors, a canister having dirt-collecting suction means and a swivel hose connector for removably connecting an end of said hose to said canister, the improvement comprising:

interlock means for swivelly securing the hose connector to said canister for unlimited swivelling movement about a swivel axis projecting from the canister;

means on said hose connector for removably securing an end of a suction hose thereto;

electrical connection means on said hose connector including a receptacle for providing an electrical connection to the electrical conductors of said hose as an incident of securing the hose end to the hose connector; and unlimitedly rotatable electrical supply means including a plurality of slide contacts movably carried by said hose connector for cooperation with a plurality of stationary commutator rings mounted on said connector for providing electrical power to said electrical connection means in all swivelling rotated positions of said hose connector.

* * * * *

UNITED STATES PATENT AND TRADEMARK OFFICE

CERTIFICATE OF CORRECTION

PATENT NO. : 4,550,958

DATED : November 5, 1985

INVENTOR(S) : Orbert S. Smith

It is certified that error appears in the above-identified patent and that said Letters Patent are hereby corrected as shown below:

Claim 9, line 2 (column 7, line 37), after "top" insert the omitted word --wall--.

Signed and Sealed this

*Nineteenth* Day of *August 1986*

[SEAL]

*Attest:*

DONALD J. QUIGG

*Attesting Officer*

*Commissioner of Patents and Trademarks*